United States Patent [19]

Conn

[11] 4,291,814

[45] Sep. 29, 1981

[54] CONTAINER WITH DRINKING TUBE

[76] Inventor: John L. Conn, P.O. Box 4501-Sta. B, Spartanburg, S.C. 29303

[21] Appl. No.: 87,320

[22] Filed: Oct. 22, 1979

[51] Int. Cl.[3] ..... A47G 19/22; B67D 5/08

[52] U.S. Cl. ..... 220/90.4; 215/1 A; 215/229; 222/529; 222/530; 222/534; 229/7 S

[58] Field of Search ..... 229/7 S; 215/1 A, 229; 222/556, 557, 527, 529, 530, 520, 536, 537, 464, 533, 534, 528; 220/90.2, 90.4

[56] References Cited

U.S. PATENT DOCUMENTS

| | | | |
|---|---|---|---|
| 962,641 | 6/1910 | Kaufmann | 220/90.2 |
| 1,617,992 | 2/1927 | Drake | 222/536 X |
| 1,913,895 | 6/1933 | Paull | 222/536 X |
| 2,146,993 | 2/1939 | Schroeder | 222/520 |
| 2,537,226 | 1/1951 | Lindsey | 222/529 |
| 2,689,076 | 9/1954 | Jenkins | 229/7 S |
| 2,957,614 | 10/1960 | Krajcovic | 222/530 X |
| 3,240,415 | 3/1966 | Push, Sr. | 229/7 S |
| 3,840,153 | 10/1974 | Devlin | 215/1 A |

*Primary Examiner*—Allan N. Shoap

[57] ABSTRACT

A beverage container has an internal vertical tube joined to an upper part of the container. An external L-shaped tube has one end interconnected to the container top in alignment with the internal vertical tube. The L-shaped tube can be rotated so that in one position the L-shaped tube overlaps the cover in a storage position and in a second position part of the L-shaped tube extends outwardly of the container for drinking. In the stored position, a porthole in the L-shaped tube is non-aligned with a porthole in the container. The portholes align when the L-shaped tube is rotated for drinking.

2 Claims, 5 Drawing Figures

CONTAINER WITH DRINKING TUBE

BACKGROUND OF THE INVENTION

1. Field of the Invention:

This invention relates to the common beverage container having a drinking tube and more particularly it refers to a tube forming a part of the closure means.

Containers with tubes have been known for years but the construction of a container having a closure tube suitable to seal a container and can also be used as an operative drinking tube is not common.

2. Brief Summary of the Invention:

It is therefore the primary object of this invention to provide an improved tube for closing a container.

It is another object of the invention to provide an improved closure tube that will serve a secondary purpose of being a useful drinking tube when in proper position.

Additional objects and advantages of the present invention is to provide an improved container having a closure tube wherein an external tube will screw connect to an internal vertical tube to seal the container by the use of non-aligning portholes at the point of maximum connection so to permit the closing, or the opening of said connection when the exterior tube is properly positioned.

BRIEF DESCRIPTION OF THE DRAWINGS

The accompanying drawings, which are incorporated in and constitute a part of this specification illustrate one design of the invention and, therefore with a description, serve to explain the principles of the invention.

OF THE DRAWINGS

Figure 1:
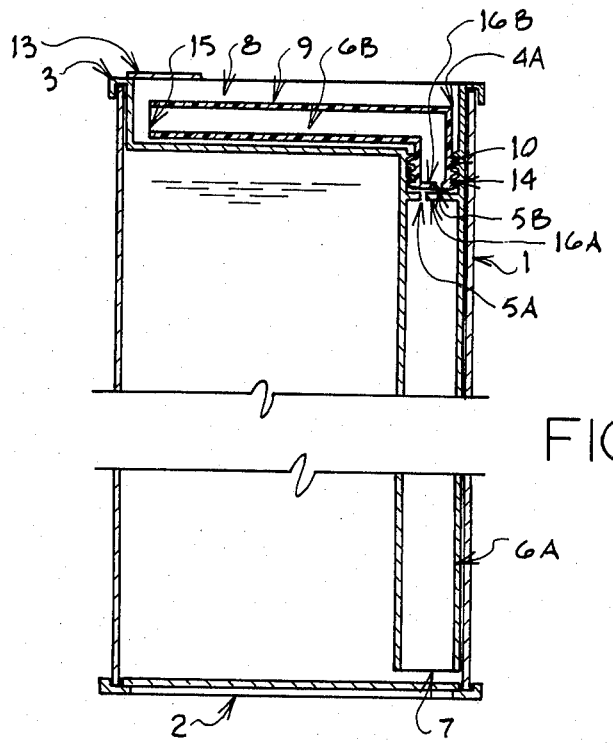
Figure 3:
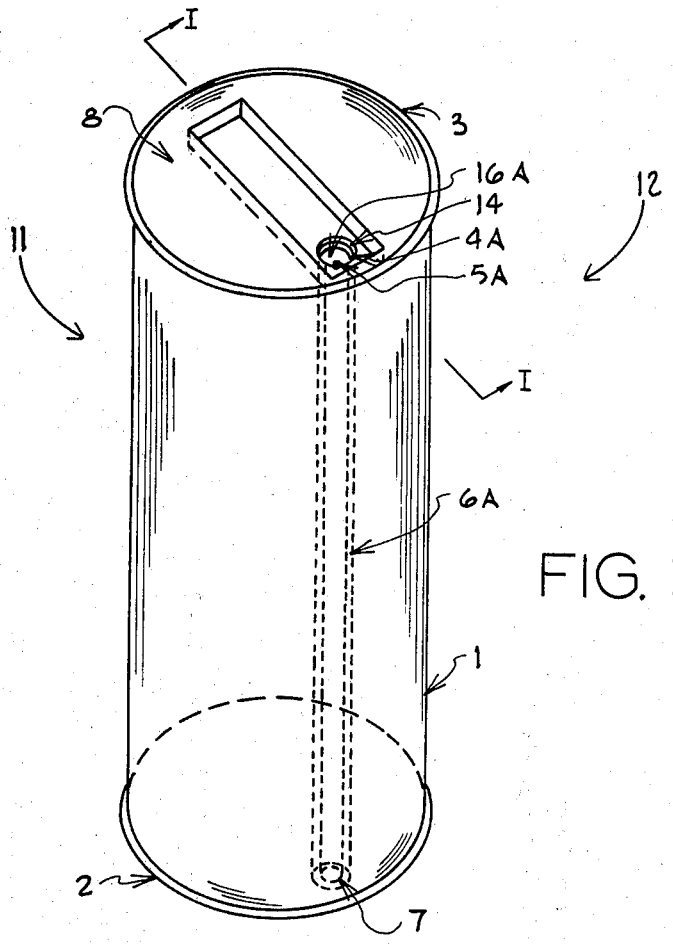

FIG. 1 is a cut-away view of the invention in the closed position taken along the line I-I in FIG. 3 but with the exterior tube and seal patch in place.

Figure 2:
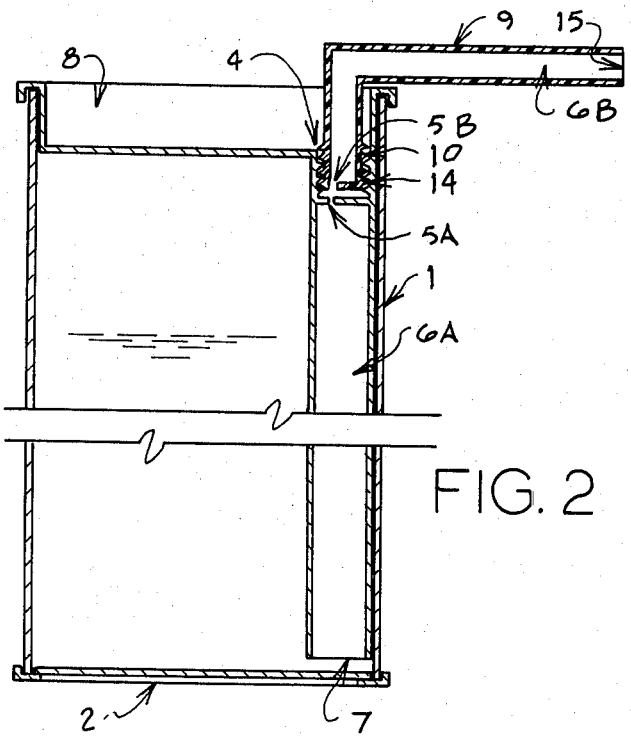

FIG. 2 is a cut-away view of the invention in the open position.

FIG. 3 is an outside view of the invention without the sealing tube.

Figure 4:
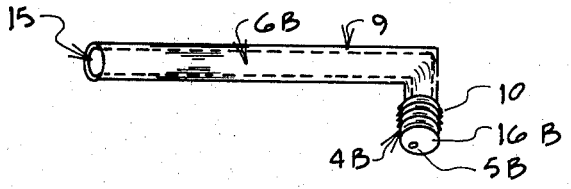

FIG. 4 is a view of the external closure tube.

Figure 5:
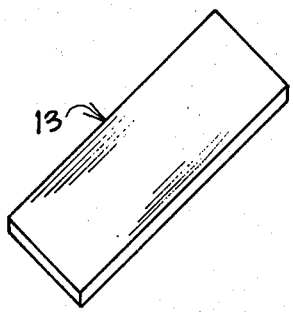

FIG. 5 is a view of the peel away seal patch.

DETAILED DESCRIPTION OF THE PREFERRED EMBODIMENTS

Reference will now be made in detail to the preferred embodiments of the invention, examples of which are illustrated in the accompanying drawings.

Referring to FIG. (1) wherein the reference numeral (1) represents a cylindrical shaped hollow container having a bottom (2) and a top surface area (3) wherein the container (1) is preferably formed of a suitable metal, such as aluminum and has a peripheral side wall (1) of generally cylindrical construction together with a bottom wall (2) suitably connected thereto to form a sealing structure which is conventional and common in the metal can industry. The upper end of the peripheral wall (1) is closed by the top wall or cover (3) by a suitable sealing structure.

A vertical tube (6A) is sealed to the top cover or lid (3) at the opening (4A) by a suitable sealing structure, or the lower edge portion of the top cover (3) opening (4A) may be serrated so that this flange area will be secured to the internal tube (6A) upon threading.

The vertical internal tube (6A) being connected to the top cover (3) wherein the top tube opening (4A) is internally threaded (14) and the tube (6A) having a height almost equal to the container's vertical height wherein said tube's (6A) top cover opening (4A) is internally threaded (14) and having a closed or sealed bottom area (16A) wherein said bottom (16A) contains an off-center porthole (5A) located directly opposite and leftwards from the center of said bottom (16A) to construct a tube opening (5A) through this sealed bottom area (16A) wherin said tube having a bottom opening (7).

The exterior drinking or sealing tube (9) is L-shaped with a shorter leg that has a vertical externally threaded end (10) and the remainder of said tube (9) is bent horizontally to shape a tube (6B) forming a larger leg that is almost as large as the top cover's recessed groove area (8). The exterior drinking tube (9) externally threaded (10) end (4B) is sealed or closed (16B) wherein said closed area (16B) contains an off-center porthole (5B) located directly opposite and rightwards from the center of said closed area (16B) to construct a tube opening (5B) through this closed area (16B) wherein the two portholes (5A & 5B) having the same circumference and having the same rotation path wherein the top container's (1) porthole (5A) is stationary but the external tube's (9) porthole (5B) will rotate when said tube (9) is rotated (11 & 12).

These portholes (5A & 5B) will construct a continuous drinking tube (6A & 6B) when the externally threaded (10) tube (9) is screw connected (12) to the container's (1) internally threaded (14) opening (4A) to position the exterior tube's (9) porthole (5B) directly over the container's porthole (5A).

The top surface area (3) has constructed a recessed rectangular shaped groove (8) that extends horizontally across said central top surface area (3) from th container's opening (4A) to the opposite side of the container (1) so to house and protect the external tube (9) during shipping.

To seal the container will be as follows:

The container (1) may be filled by removing (11) the external tube (9) and filling the container (1) through the porthole (5A) and then the external tube (9) is connected (12) to the container (1) wherein the external tube (9) will pressure snap into the groove (8), due to the flexible material, and remain housed in said groove (8) until ready to use. When in the sealed position the portholes (5A & 5B) will not be aligned and thus said container (1) is sealed. A peel-away seal patch (13) is sealed over the tube's end (15) to keep sanitary and retain the tube in the groove (8).

To open the container for use will be as follows:

The peel-away seal patch (13) is removed from the exterior tube (9) and the tube's end (15) is raised upward, due to the flexible material, and turned in a counter clock-wise direction (11) to 180 degrees to position the portholes (5A & 5B) to an open and aligned position to construct a continuous tube (6A & 6B) and then proceed to consume the contents by the siphoning method.

Be it noted that the complete top cover (3); the exterior tube (9); and the internal tube (6A) may all be constructed as one integral assembly and then pressed upon the container (1) as is commonly done.

Be it also noted that this complete disclosure may be constructed from molded plastic.

Be it also noted that the thread lead is so constructed so that a one-half revolution will position the exterior tube in a drinking position from a closed position.

While various changes may be made in the design it is hoped that such changes will not alter the scope of the invention as to what is claimd.

What is claimed:

1. The construction of a container with drinking tube comprising:

a cylindrical shaped hollow container body for holding a fluid and having a bottom wall and a top wall, an interior tube extending vertically downwardly from said top wall into said body and having an opened bottom adjacent to and spaced from said bottom wall, said interior tube having an opened top, said interior tube internally threaded adjacent said opened top and adapted to receive a corresponding externally threaded end of an exterior tube, a transverse wall in said interior tube below and adjacent from where said interior tube is threaded thereby separating said interior tube into an upper part and a lower part, porthole means through said transverse wall off center from the central, longitudinal axis of said interior tube providing the only fluid passage between said upper part and said lower part, said top wall having a rectangularly shaped groove extending across the central portion of said top wall, said opened top of said interior tube located within said groove, said groove adapted to receive a portion of the exterior tube.

2. The construction of claim 1 further including said exterior tube, said exterior tube being flexible and L-shaped, the smaller leg of the L-shaped exterior tube externally threaded about the end thereof and cooperating with the internally threaded part of said interior tube, the larger leg of said L-shaped exterior tube being adapted to be received in said groove, said exterior tube having a transverse wall adjacent said end of said smaller leg, porthole means through the transverse wall of said exterior tube located off center from the central, longitudinal axis of said smaller leg of said exterior tube, said porthole means of said exterior tube located off center in a direction radially opposite to the radial extension of said larger leg, said porthole means of said exterior tube providing the only fluid passage into said smaller leg from said interior tube, the porthole means of said exterior tube being diametrically opposite the porthole means of said interior tube when said larger leg is received in said groove during non-use of said exterior tube, both porthole means being substantially aligned when said larger leg is withdrawn from said groove and said exterior tube rotated substantially 180 degrees so that said larger leg extends radially outwardly from said container body to allow fluid to be siphoned from said container body.

* * * * *